United States Patent [19]

Taipale et al.

[11] Patent Number: 4,607,649

[45] Date of Patent: Aug. 26, 1986

[54] COIN SORTER

[75] Inventors: Dale L. Taipale, Delafield; John H. Winkelman, Hartland, both of Wis.

[73] Assignee: Brandt, Inc., Watertown, Wis.

[21] Appl. No.: 563,804

[22] Filed: Dec. 21, 1983

[51] Int. Cl.[4] ..... G07D 3/00

[52] U.S. Cl. ..... 133/3 C

[58] Field of Search ..... 133/3 R, 3 A, 3 C

[56] References Cited

U.S. PATENT DOCUMENTS

| | | | |
|---|---|---|---|
| 574,528 | 1/1897 | Elder et al. | 133/3 C |
| 2,835,260 | 5/1958 | Buchholz | 133/8 |
| 2,906,276 | 9/1959 | Blanchette et al. | 133/3 A |
| 4,086,928 | 5/1978 | Ristvedt et al. | 133/3 A |
| 4,098,280 | 7/1978 | Ristvedt et al. | 133/3 A |
| 4,234,003 | 11/1980 | Ristvedt et al. | 133/3 A |
| 4,360,034 | 11/1982 | Davila et al. | 133/3 A |
| 4,444,212 | 4/1984 | Ristvedt et al. | 133/3 A |
| 4,506,685 | 3/1985 | Childers et al. | 133/3 A |
| 4,531,531 | 7/1985 | Johnson et al. | 133/3 A |
| 4,543,969 | 10/1985 | Rasmussen | 133/3 A |
| 4,564,037 | 1/1986 | Childers et al. | 133/3 A |

FOREIGN PATENT DOCUMENTS

| | | | |
|---|---|---|---|
| 2296361 | 8/1976 | France | 133/3 C |

*Primary Examiner*—John J. Camby

*Attorney, Agent, or Firm*—Quarles & Brady

[57] ABSTRACT

A coin sorter is disclosed in which a flexible rotating disc opposes a stationary plate that has surfaces which form a series of guide surfaces which are spaced from the disc a distance less than the thickness of coins to be sorted. Coins are deposited on the rotating disc through a central opening in the plate. The guide surfaces form the coins into a single layer and single file at the periphery of the disc. The coins in the single file are pinched between the disc and plate with their inner edges against an outwardly facing spiral shoulder and with their outer edges projecting beyond the perimeter of the disc. The coins in the single file are engaged, in descending order of diameter, by a series of stationary plows spaced about the periphery of the disc. When engaged by a plow, each coin is removed from the pinch between the rotating disc and the plate and is sorted off from the disc at that point.

16 Claims, 6 Drawing Figures

COIN SORTER

BACKGROUND OF THE INVENTION

This invention relates to coin handling, and more particularly to an improved mechanism for sorting coins of mixed denominations.

There are several basic types of coin sorting equipment which can be classified based upon their principle of operation. First if a so-called rail sorter in which coins are rolled on edge, single file down an inclined ramp or rail. In order of size, each coin denomination is removed at a particular point on the ramp or rail. Removal may be by way of protrusions, called plows, which bump a coin of a particular size off the rail. Naturally, the larger coins must be removed before the smaller coins. An example of such a rail-type sorter is found in U.S. Pat. No. 574,528, issued Jan. 5, 1897 to Elder, et al. A second form of coin sorter is the so-called core sorter in which individual coins are carried by an inclined rotating scalloped plate to an elevated opening where the coins are discharged into tapered slots arrayed about the periphery of a rotating core shaped like a truncated cone. The coin settles to a particular level in the tapered slot which is indicative of its size, and therefore its denomination, and is counted and removed from that level. An example of the core sorter is found in U.S. Pat. No. 2,835,260, issued May 20, 1958 to Buchholz. A third form is the sifter type of sorter in which the coins pass through a series of perforated plates of descending opening size until caught at a level appropriate to their size. An example of sifter-type sorter is found in U.S. Pat. No. 4,360,034 issued Nov. 23, 1982 to Davila, et al.

Still another form of sorter employs a horizontal rotating disc and mechanisms by which the coins are carried by centrifugal force to an outer rim where the coins are formed into a single file. The coins may be removed at various points on the periphery by plows (see U.S. Pat. No. 2,906,276, issued Sept. 29, 1959 to Blanchette, et al.), or by flipping them over the rim (see U.S. Pat. No. 4,086,928, issued May 2, 1978 to Ristvedt, et al.). This latter patent utilizes a rotating disc which has an upper surface formed as a flexible mat which is compressible by the coins. Another approach using a flexible rotating disc is found in U.S. Pat. No. 4,098,280, issued July 4, 1978 and its related U.S. Pat. No. 4,234,003, issued Nov. 8, 1980 to Ristvedt, et al. In that approach, the coins are arrayed in a single file against a ledge until they encounter spaced areas where the coins are no longer held between a sorter plate and the rotating disc and are free to be thrown from the disc by centrifugal force.

The coin sorter of the present invention also utilizes a rotating resilient disc but operates on the principle that the coins are continuously pinched between the disc and an overlying sorter plate until they are physically removed at spaced stations around the periphery of the disc, with each station unique to a particular denomination of coin. The disc surface has a high coefficient of friction compared to the plate so that it carries coins over the surface of the plate as the disc rotates.

SUMMARY OF THE INVENTION

In accordance with the invention, a coin sorter includes a rotating resilient disc with an opposing stationary sorter plate which directs coins to a single layer, single file about the perimeter of the disc, the single file of coins being pinched between the sorter plate and the disc, together with means disposed about the perimeter of the plate for removing the coins by size at spaced locations about the perimeter.

Further in accordance with the invention the sorter plate has a shoulder which extends toward the disc along a portion of the periphery of the plate, the shoulder is formed along a spiral path, and the file of coins is aligned with their innermost edges against the shoulder and with the coins projecting beyond the edge of the disc at the location where they are to be engaged for removal.

Also in accordance with the invention, the means for removing the coins by size includes a series of stationary plows disposed about the periphery of the plate and each spaced from the plate a distance which will engage one particular denomination of coin in the file of coins, the coins being removed by order of size with the largest coin being removed first.

Still further in accordance with the invention, there is provided a mechanism for aligning a series of coins into a single layer, single file which includes a rotating resilient disc and an opposing stationary plate having a central opening through which coins can be placed on the disc and which also includes a series of guide surfaces confronting the disc which urge the coins to move into a single file and then into a single layer adjacent the periphery of the disc where the coins are pinched between the sorter plate and the disc.

It is an object of the present invention to provide an accurate and effective coin sorter which has few moving parts and which can sort coins of many different denominations.

It is another object of the invention to provide such a coin sorter in which a mix of coins are aligned and held in a single file between two opposing surfaces until physically removed.

It is another object of the invention to provide such a coin sorter which is adaptable to sorting the coinage of a wide variety of countries.

It is still another object of the invention to provide a mechanism for aligning coins in a single layer, single file for subsequent handling in a wide variety of coin handling equipment including sorters.

The foregoing and other objects and advantages of the invention will appear in the description which follows. In the description, reference is made to the accompanying drawings which illustrate a preferred embodiment of the invention.

DETAILED DESCRIPTION OF THE PREFERRED EMBODIMENT

Figure 1:
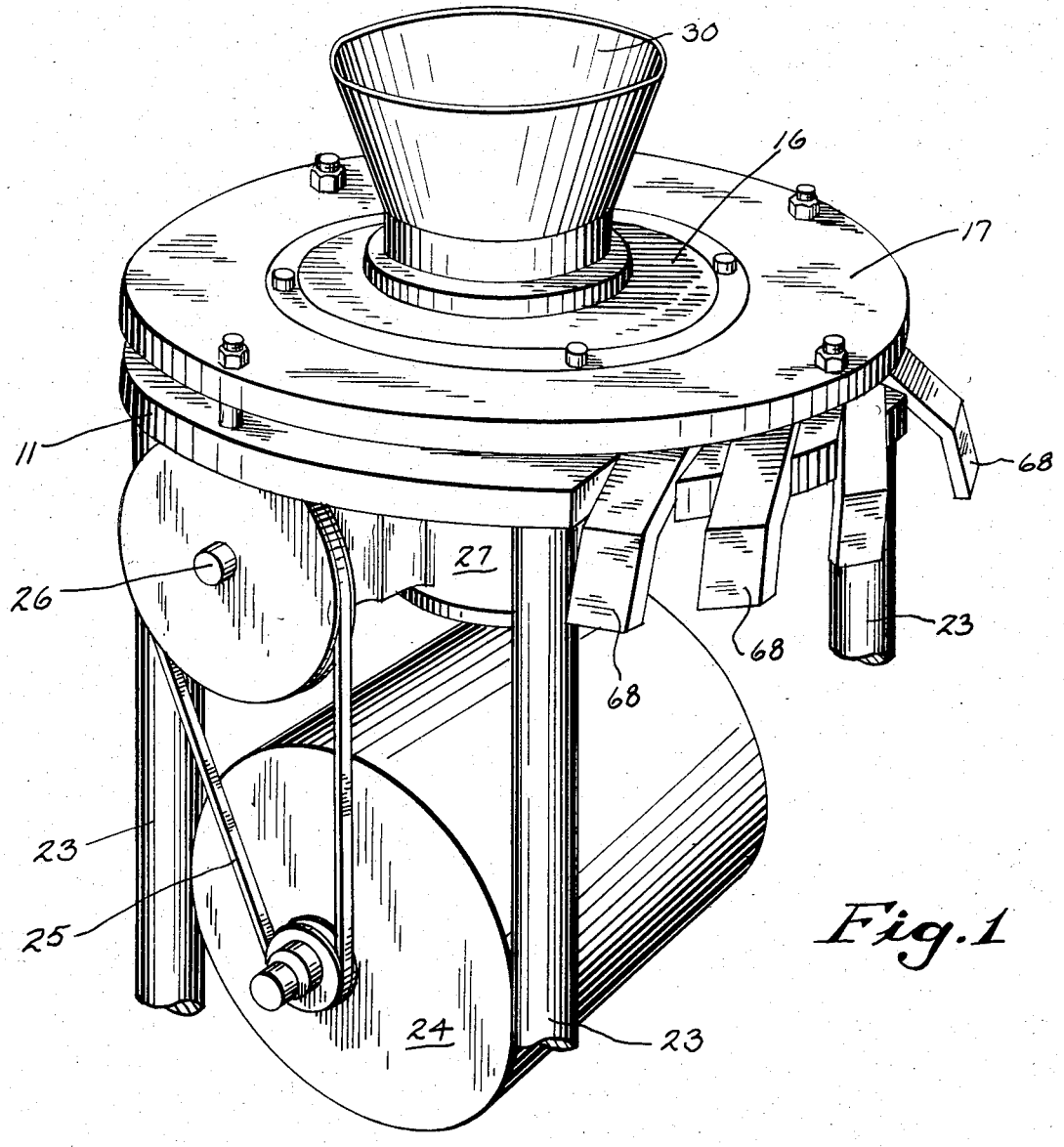
FIG. 1 is a view in perspective of a coin sorter incorporating the present invention.
Figure 2:
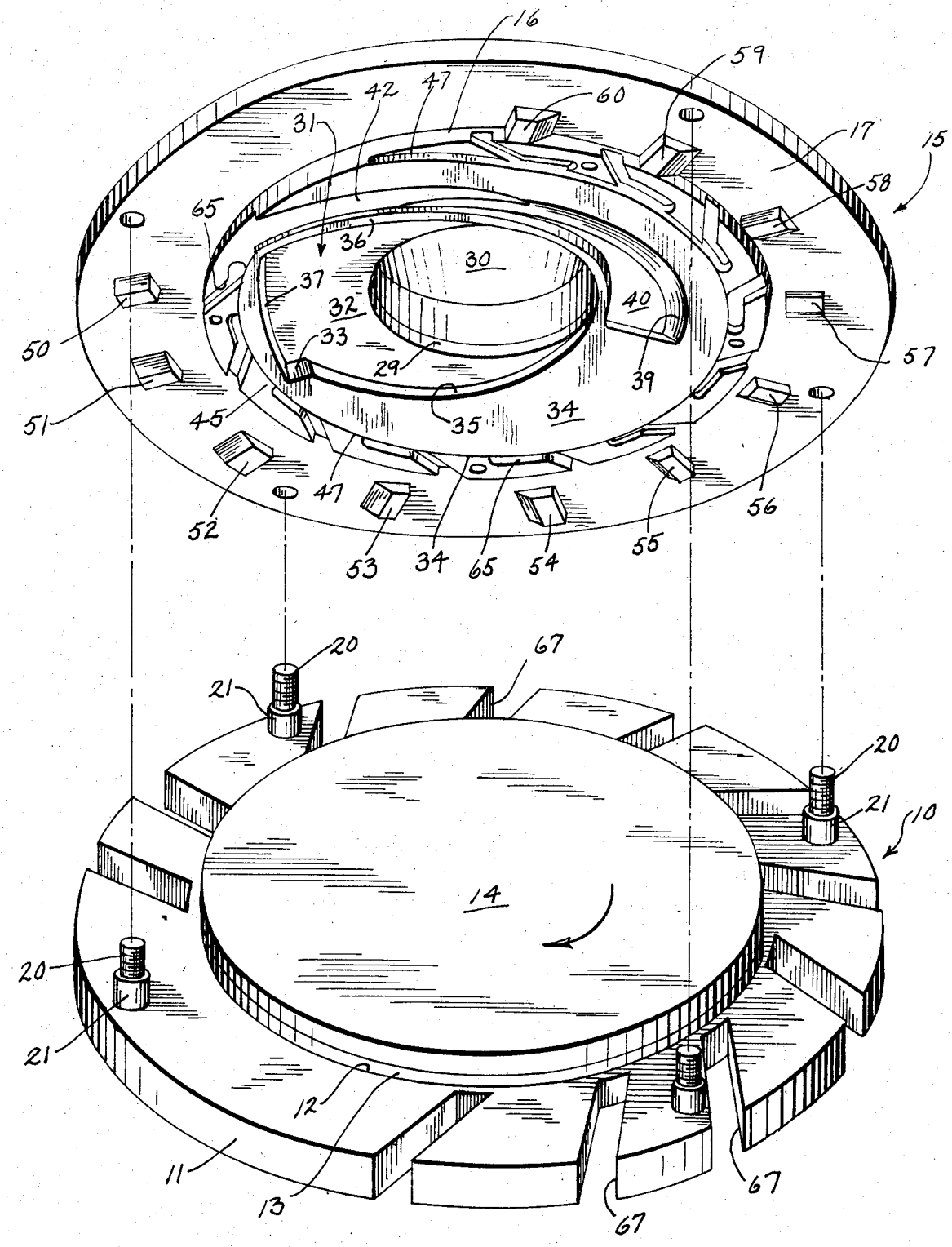
FIG. 2 is an exploded view in perspective illustrating the arrangement of the resilient disc and overlying sorter plate together with the plow mechanism for removing the coins after they have been aligned into a single file.

Referring to FIGS. 1 and 2, the coin sorter includes a lower assembly 10 comprised of an outer discharge ring 11 having a central opening 12 and a horizontal disc 13 disposed in the central opening 12. The disc 13 has an upper surface in the form of a flexible resilient pad 14. The pad 14 is formed of a natural or synthetic rubber or other elastomer having a coefficient of friction of approximately 0.5 and being deformable. An upper assembly 15 comprises a central sorter plate 16 and an outer plow ring 17 in which the sorter ring 16 is mounted. The upper assembly 15 is joined to the lower assembly 10 by a series of threaded bolts 20 with spacers 21 which control the spacing between the upper and lower assemblies. As will appear hereafter, that spacing is important to the principle of operation of the sorter.

A series of legs 23 support the lower assembly 10 at a level above a table top or other surface on which the sorter is positioned. An electric motor 24 is disposed beneath the lower assembly 10 and is connected by a belt drive 25 to the input shaft 26 of a right angle drive 27 which drives the shaft for the rotatable disc 13. The disc 13 with its resilient pad 14 rotates in a clockwise direction as viewed from above and in FIG. 2.

The sorter plate 16 has an opening 29 adjacent its center. A hopper 30 is connected to the opening 29 so that a supply of coins can be directed through the opening 29 to the top surface of the pad 14. The sorter plate 16 is formed of metal and therefore has surfaces which have a low coefficient of friction in comparison with that of the pad 14. The rotating pad 14 will urge coins to move over the surfaces of the sorter plate 16. The sorter plate 16 has a series of guide surfaces which, in general, will direct coins from an area adjacent the central opening 29 first into a single row except for overlapping coins and then into a single layer by moving the overlapping coins back to the area adjacent the central opening. In this way, the coins will be formed into a single layer, single file at a position adjacent the perimeter of the plate 16. Specifically, the sorter plate 16 includes a coin collection area 31 which is defined by a surface 32 disposed about a portion of the central opening 29. The surface 32 is spaced from the pad 14 a distance which is greater than the thickness of the largest coin to be handled. Thus, in the collection area 31 several layers of coins may accumulate.

Figure 3:
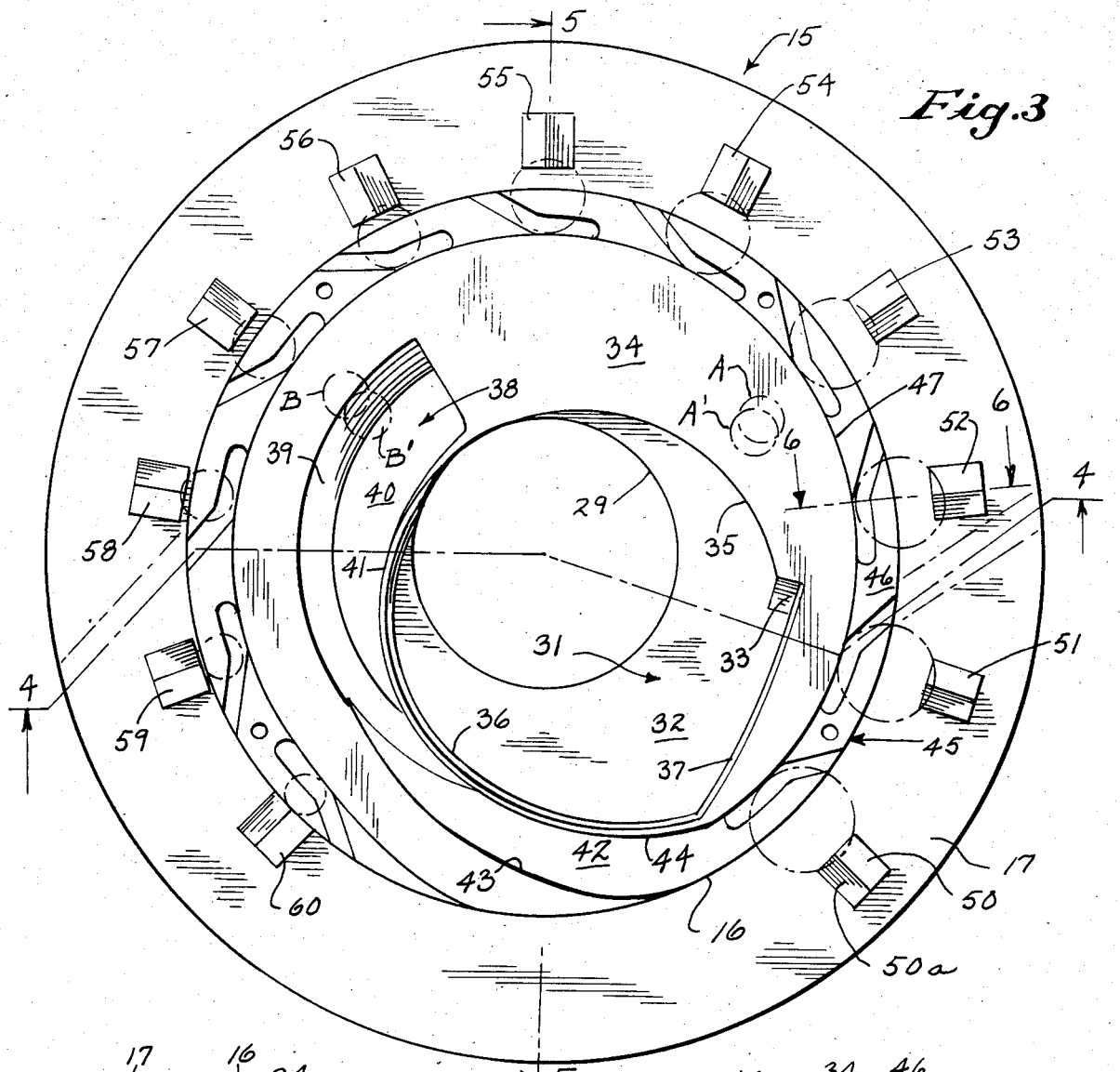
FIG. 3 is a plan view of the underside of the sorter plate and plows.
Figure 4:
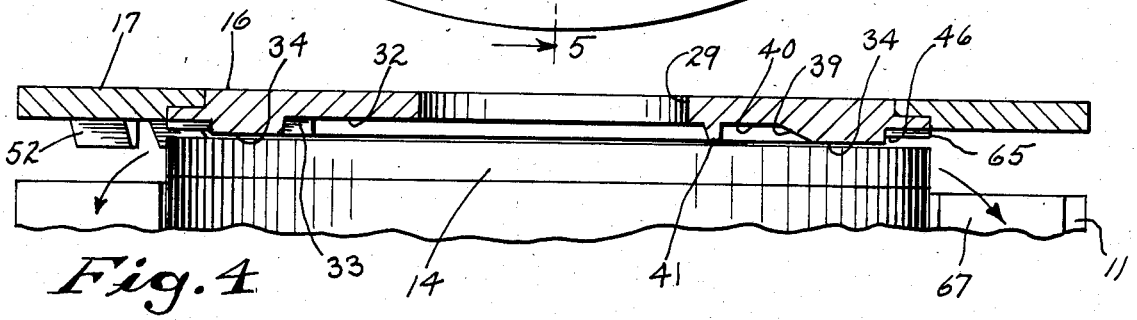
FIG. 4 is a view in vertical section through the sorter plate and rotating disc and taken in the plane of the line 4—4 of FIG. 3.
Figure 5:
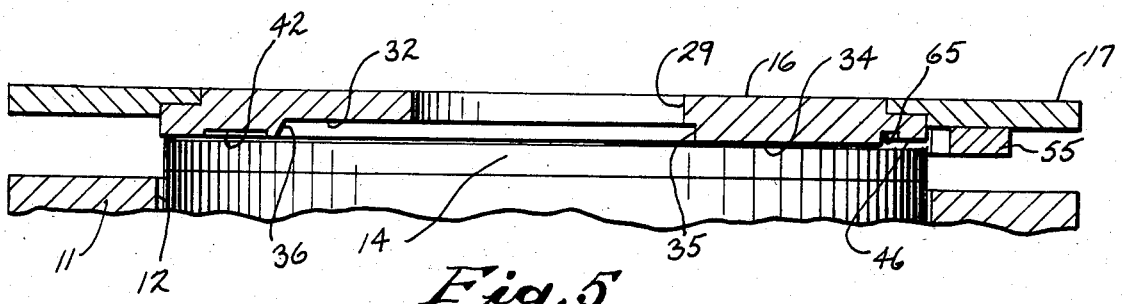
FIG. 5 is a view in vertical section similar to FIG. 4 but taken in the plane of the line 5—5 of FIG. 3.

A ramp 33 is formed on the underside of the sorter plate 16 and leads from the collection area 31 to a first guide surface 34. The purpose of the ramp 33 is to make a course separation of the coins in the collection area 31 into a single file or row. The ramp 33 has a width about equal to the diameter of the smallest coin to be handled so that only one row of coins of the smallest size should be able to travel over the ramp 33 to the first guide surface 34. However, because of overlapping and interleaving of coins, it is possible for more than one row of coins abreast to be directed to the first guide surface 34. (See the overlapped coins A and A' shown in phantom lines on FIG. 3.)

The first guide surface 34 is spaced at "zero" distance from the top surface of the resilient pad 14. That is, there is practically no clearance between the surface and any clearance will be only a fraction of the thickness of the thinnest coin. For U.S. coins, the spacing will be between 0 and 0.010 inches. Coins which travel over the ramp 33 to the first guide surface 34 will be pinched very tightly between the surfaces, and overlapping coins will not be able to separate. However, the radially innermost row or rows of overlapping coins will project over an arcuate edge 35 of the first guide surface 34 and will move back into the collection area 31. The collection area 31 is defined by two additional arcuate edges 36 and 37 both of which are tapered so that coins directed against them will not bounce back toward the opening 29.

The first guide surface 34 will maintain the radial position of coins first pinched at the ramp 33 as they travel over the first guide surface 34. Overlapped coins must be removed, however, and that is the function of a relief area 38 formed in a radially inward portion of the first guide surface 34. The relief area 38 includes a sharply tapered arcuate edge 39 leading to a surface 40 which is spaced a considerable distance above the surface of the pad 14; a distance which substantially exceeds the thickness of the thickest coin handled. When overlapped coins encounter the relief area 38, the pinching pressure holding the overlapped coins together will be removed entirely as to the radially inward coin. (See the coins B and B' shown in phantom lines on FIG. 3.) The radially innermost coin will then be moved by the pad 14 over a ledge 41 which is in the path of the unpinched coins. The ledge 41 is formed along the edge 36 of the collection area 31. As a result, coins which are removed from the first guide surface 34 at the relief area 38 will be moved back to the collection area.

When coins have passed the relief area 38 they will be in a single row or file and in a single layer. The coins next are urged by the pad 14 to a second guide surface 42 which is formed at the end of the first guide surface 34. The second guide surface 42 is spaced from the pad 14 a distance which is greater than the spacing of the first guide surface 34 from the pad 14 but still less than the thickness of the thinnest coin. The difference in elevation results in two shoulders 43 and 44 defining the sides of the second guide surface 42. The shoulder 44 constitutes an extension of the ledge 41 and coins moved onto the second guide surface 42 will have their inner edges placed against the shoulder 44. The shoulder 44 extends along a spiral path and will carry coins toward the periphery of the sorter plate 16 where the coins encounter a peripheral track 45.

The track 45 has a track surface 46 which opposes the top surface of the pad 14. At least the radial outer edge of the track surface 46 is spaced from the pad a distance less than the thickness of the thinnest coin so that the coins are pinched while on the track 45. A peripheral shoulder 47 defines the inner edge of the track 45. The track shoulder 47 is formed as a spiral so that the shoulder is closer to the periphery of the sorter plate 16 at the end of the track 45 than at its beginning at the second guide surface 42. Coins which are guided by the second guide surface 42 to the peripheral track 45 will continue to be pinched between the track surface 46 and the pad 14 and will be continuously urged against the spiral shaped track shoulder 47 so that their inner edges will be disposed against the shoulder 47. By the cooperation of the ramp and surfaces of the sorter plate and the resilient pad 14, coins will have been formed into a single layer and a single file in the peripheral track 45. The pinching force exerted by the sorter plate 16 and pad 14 on the coins will be sufficient to hold them against the effects of centrifugal force and it is therefore necessary to physically remove them from the track 45.

Figure 6:
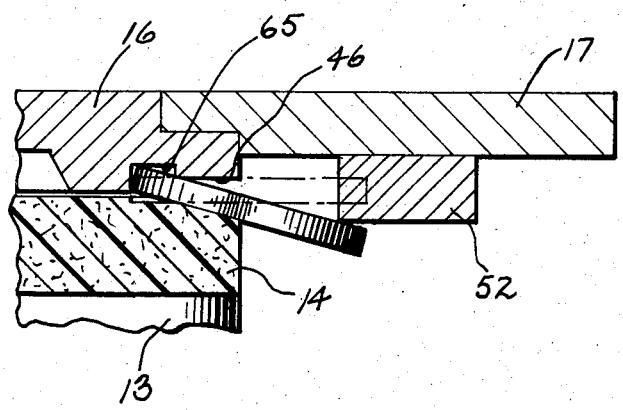
FIG. 6 is a view in vertical section on an enlarged scale taken in the plane of the line 6—6 of FIG. 3 and illustrating the removal of a coin from the periphery of the sorter plate.

The mechanism for removing the coins from the single file in the track 45 includes a series of plows 50 through 60 each of which is mounted on the underside of the plow ring 17 and each of which is disposed at a unique distance from the shoulder 47 of the track 45. The plows are each encountered by a coin of a particular size as the coins are carried about the track 45. The first plow 50 is is spaced a distance from the shoulder 47 which is less than the diameter of the largest coin but which is greater than the diameter of the next largest coin. As a result, the largest diameter coin will encounter an inclined surface 50*a* and will be tilted as it rides up the plow 50. (See FIG. 6). The radially inner edge of the tilted coin will be directed into a channel 65 formed in the surface 46 of the track 45. There is one channel 65 at each plow location or station. The channels 65 each extend for a distance along the shoulder 47 of the track 45 and then angle outwardly to the perimeter of the sorting plate 16. A coin which encounters a plow and is tilted thereby will depress the outer edge of the pad 14 and will be forced along the channel 65 until the channel 65 directs it free of the sorter plate and of the pad. The exiting coins will travel through discharge openings 67 each of which mounts a discharge chute 68 which carries that particular denomination of coin to a particular collection point (not shown).

Because of the spiral shape of the track shoulder 47, the smallest diameter coins may not extend beyond the perimeter of the sorter plate at the widest portion of the track 45. The track shoulder 47 is so shaped, however, that even the smallest coin to be handled will extend beyond the edge of the track 45 when it reaches the final plow station. It is, however, possible to use the end of the track 45 beyond the last plow station to off-sort a coin of even smaller diameter since the shoulder 47 merges with the perimeter of the plate 16.

Greater versatility can be provided by mounting each of the plows for adjustment along a line toward and away from the shoulder 47. One standard coin sorter machine can then be used for different coinage systems or for mixtures of coins and tokens by simply adjusting the spacing between the plows and the shoulder of the track.

Because of the unique way in which coins are formed into a single layer in a single file while always being pinched between the rotating resilient pad and the underside of the sorter plate, a major portion of the outer perimeter of the pad and sorter plate is available for sorting stations. As a result, a large numbr of different size coins can be sorted. In the preferred embodiment illustrated, eleven sorting stations are shown. Coinage systems which are foreign to the United States can be easily accommodated.

Because the coins are always gripped between the sorter plate 16 and the resilient pad 14 until physically removed by a plow or similar mechanism, the lower and upper assemblies 10 and 15, respectively, need not be disposed in a horizontal plane but may be mounted at an angle if desired for purposes of conserving space.

The system of forming the single layered, single file of coins can be used in coin handling equipment other than coin sorters. Thus, forming coins of a single denomination into a single layer, single file can be used in coin wrapping equipment of the type illustrated for example in U.S. Pat. No. 4,089,151, issued May 16, 1978 to Bergman et al.

Counters may be placed at each sorting station or discharge chute 68 on the coin sorter to count the coins as they exit the sorter plate and pad so that a count may be kept and recorded of the coins of each particular denomination as they are sorted.

We claim:

1. A coin sorter for mixed denominations of coins, comprising:

a rotatable resilient disc;

means for rotating said disc;

a stationary sorter plate spaced from said disc, said sorter plate having a central opening so that coins may be placed on said disc, said sorter plate also having a series of guide surfaces opposing said disc and spaced closer to said disc than the thickness of the thinnest coin to be sorted, said guide surfaces adapted to pinch coins between the sorter plate and said disc to cause a single layr of coins of mixed denomination to form in a single file at the periphery of the disc as said disc rotates, said guide surfaces including an outer peripheral track surface at the periphery of the sorter plate with the single file of coins being pinched at the periphery between the track surface of the sorter plate and the disc; and a plurality of graduated sorting stations spaced about the periphery of said disc and each including means external of the periphery of said disc and adapted to engage and release coins from the pinch between the sorter plate and disc in descending order of their diameter.

2. A coin sorter in accordance with claim 1 wherein said sorting stations each include a channel formed in the sorter plate and leading from a point adjacent the innermost edge of the file of coins to the periphery of the sorter plate, and a plow engaging the outermost edge of the coin at each station to tip the innermost edge of the coin into the channel.

3. A coin sorter for mixed denominations of coins, comprising:

a rotatable resilient disc;

means for rotating said disc;

a stationary sorter plate spaced from said disc, said sorter plate having a central opening so that coins may be placed on said disc, said sorter plate also having a series of guide surfaces opposing said disc and spaced closer to said disc than the thickness of the thinnest coin to be sorted, said guide surfaces adapted to pinch coins between the sorter plate and said disc to cause a single layer of coins of mixed denomination to form a single file at the periphery of the disc as said disc rotates;

said series of guide surfaces including a first guide surface disposed at a distance from the disc which is substantially less than the thickness of the thinnest coin to be sorted, a ramp connecting said first guide surface to an area adjacent said central opening, a second guide surface disposed at a second distance from the disc which is greater than the distance of the first guide surface from said disc but still less than the thickness of the thinnest coin to be sorted, and an outer peripheral track at the perimeter of said sorting plate, at least a portion of the radial width of said track being spaced from said disc a distance which is less than the thickness of the thinnest coin, said track including an outwardly facing shoulder against which the inner edge of the file of coins is positioned; and a plurality of graduated sorting stations spaced about the periphery of said disc and each including means adapted to engage and release coins from the pinch between the sorter plate and disc in descending order of their diameter.

4. A coin sorter in accordance with claim 3 wherein said area adjacent said central opening is defined by a surface of said sorter plate which is spaced from said disc a distance greater than the thickness of the thickest coin to be sorted.

5. A coin sorter in accordance with claim 3 wherein said shoulder is formed as a spiral.

6. A coin sorter in accordance with claim 3 together with a relief area provided in said first guide surface before said second guide surface, said relief area including a surface which is spaced from the disc a distance greater than the thickness of the thickest coin to be sorted.

7. A coin sorter, comprising:

a rotating disc having a resilient, relatively high friction surface;

a stationary sorter plate confronting said disc surface and including a peripheral track with a relatively low friction surface facing towards the disc surface and at least a portion of the radial width of the track surface being spaced a distance from the disc surface which is less than the thickness of the thinnest coin to be sorted, said track including a shoulder spaced inwardly from the periphery of the sorter plate and following a spiral path;

means for delivering a single layer of coins in a single file to said track where said coins are pinched between the opposing surfaces of said disc and sorter plate and with the inner edge of the file of coins disposed against said shoulder; and means for removing coins from said track in descending order of size at spaced points about the perimeter of said sorter plate.

8. A coin sorter in accordance with claim 7 wherein said shoulder is spaced inwardly of the periphery of the sorter plate a distance less than the diameter of the smallest coin to be sorted, and said removal means includes a series of protrusions each spaced a distance from said shoulder which is unique to a particular size of coin to be sorted so that the outer edges of all coins of that size will be engaged by the respective protrusion as the coins are carried along said track.

9. A coin sorter in accordance with claim 8 wherein said removal means also includes a channel in said track opposite each protrusion, said channels extending from a point adjacent the shoulder to the perimeter of the sorter plate to engage the inner edge of the coin engaged by the respective protrusion and to direct the coins off of the track.

10. A coin sorter in accordance with claim 7 together with a discharge chute at each spaced point to receive coins removed from the track at that point.

11. A coin handling mechanism for forming a plurality of coins into a single layer and a single file, comprising:

a rotatable resilient disc;

means for rotating said disc;

a stationary plate having surfaces confronting said disc, said plate including a central opening so that coins may be placed against said disc, a ramp leading from an area adjacent said central opening to a first guide surface which extends in an arcuate direction and leads to a second guide surface which in turn leads to a peripheral track surface at the perimeter of said plate, said second guide surface and at least a portion of the radial width of said track surface being disposed at a distance from said disc which is less than the thickness of the coins, and said first guide surface being disposed at a distance from said disc which is less than the spacing of said second guide surface and track surface from said disc.

12. A coin handling mechanism for forming a plurality of coins into a single layer and a single file, comprising:

a rotatable resilient disc;

means for rotating said disc;

a stationary plate having surfaces confronting said disc, said plate including a central opening so that coins may be placed against said disc, a collection area adjacent said opening in which multiple layers of coins can be accommodated, a ramp leading from said collection area to a first guide surface which is at substantially zero distance from said disc and extends in an arcuate direction, a relief area formed along a radially inward portion of said first guide surface at a distance from said ramp, said relief area including a surface which is spaced from said disc a distance greater than the thickness of the coins, and a second guide surface at the end of said first guide surface and beyond said relief area, said second guide surface leading to the perimeter of said plate and being spaced from said disc a distance less than the thickness of the coins.

13. A coin handling mechanism for forming a plurality of coins into a single layer and a single file, comprising:

a rotatable resilient disc;

means for rotating said disc; and a stationary plate having surfaces confronting said disc, said plate including a central opening so that coins may be placed against said disc, said plate also having a series of guide surfaces spaced from the disc a distance that is less than the thickness of the coins and including arcuate shoulders that face outwardly from the central opening of said plate, said guide surfaces adapted to pinch coins between the plate and said disc to urge a single layer of coins to form in a single file with their inner edges against the shoulders.

14. A coin handling mechanism for forming a plurality of coins into a single layr and a single file, comprising:

a rotatable disc having a resilient surface;

means for rotating said disc; and a stationary plate having non-resilient surfaces confronting the resilient surface of said disc, said plate including a central opening so that coins may be placed against said disc, said non-resilient surfaces including a series of guide surfaces spaced from the disc a distance that is less than the thickness of the coins and at least one arcuate shoulder that faces outwardly towards the perimeter of said plate, said guide surfaces adapted to pinch coins between the plate and said disc to urge a single layer of coins to form in a single file with their inner edges against the shoulder as said disc rotates.

15. A coin handling mechanism in accordance with claim 14 wherein said shoulder follows a spiral path.

16. A coin sorter, comprising:

a rotatable disc with a resilient surface;

means for rotating said disc;

a hard stationary sorter plate confronting said resilient surface and including a peripheral track facing the resilient surface, at least a portion of the radial width of the track surface being spaced a distance from the resilient surface that is less than the thickness of the thinnest coin to be sorted, said track including a shoulder spaced inwardly from the periphery of the sorter plate a distance less than the diameter of the smallest coin to be sorted;

means for delivering a single layer of coins in a single file to said track where said coins are pinched between the opposing surfaces of said disc and sorter plate and with the inner edge of the file of coins disposed against said shoulder; and means for engaging the projecting edges of the coins in said single file and for removing coins from the track in descending order of size at spaced points about the perimeter of said sorter plate.

* * * * *